United States Patent [19]

Carilli

[11] Patent Number: 5,036,989

[45] **Date of Patent: * Aug. 6, 1991**

[54] TEST TUBE SUPPORT SYSTEM

[76] Inventor: Brian D. Carilli, 2150 Columbia, Palo Alto, Calif. 94306

[ * ] Notice: The portion of the term of this patent subsequent to Jul. 3, 2007 has been disclaimed.

[21] Appl. No.: 538,197

[22] Filed: Jun. 14, 1990

Related U.S. Application Data

[63] Continuation-in-part of Ser. No. 370,643, Jun. 22, 1989, Pat. No. 4,938,369.

[51] Int. Cl.[5] ..... A47F 7/00

[52] U.S. Cl. ..... 211/74; 211/60.1

[58] Field of Search ..... 211/74, 60.1, 71, 77

[56] References Cited

U.S. PATENT DOCUMENTS

| | | | |
|---|---|---|---|
| 2,189,989 | 2/1940 | Lichtman | 211/74 |
| 3,233,804 | 2/1966 | Dahm | 211/74 X |
| 3,379,315 | 4/1968 | Broadwin | 211/74 X |
| 3,674,198 | 7/1972 | Eberle | 211/74 X |
| 3,778,232 | 12/1973 | McMorrow | 211/74 X |
| 4,068,798 | 1/1978 | Rohde | 211/74 X |
| 4,938,369 | 7/1990 | Cavilli | 211/60.1 |

OTHER PUBLICATIONS

Sargent-Welch Catalog, "Supports", pp. 1020–1023, 1971.

*Primary Examiner*—Robert W. Gibson, Jr.
*Attorney, Agent, or Firm*—Flehr, Hohbach, Test, Albritton & Herbert

[57] ABSTRACT

A test tube support system simultaneously holds a plurality of test tubes of different sizes. In one embodiment, the test tube support system includes a plurality of rectangular box-shaped units, each having four faces. The faces are injection molded plastic plates, each having a depth of between 0.25 and 0.50 inches with a plurality of tapered holes therethrough. More generally, the plates have sufficient depth to prevent tipping of test-tubes stored vertically therein. Also, the holes in each plate are of differing diameter than the other plates of the unit. A support or carrier tray holds a plurality of these units. Each unit may be differently oriented so that test tubes of various sizes may be stored in the test tube support system. In another embodiment, the test tube support system has a multiplicity of rectangular, plastic, injection molded plates, similar to the plates in the rectangular box-shaped units. A carrier tray is designed to receive and retain several plates and to provide empty space below the holes in the plates. The tray is designed to allow individual ones of the plates to be removed and replaced with other ones of the plates so that test tubes of various sizes may be stored in the test tube support system.

9 Claims, 8 Drawing Sheets

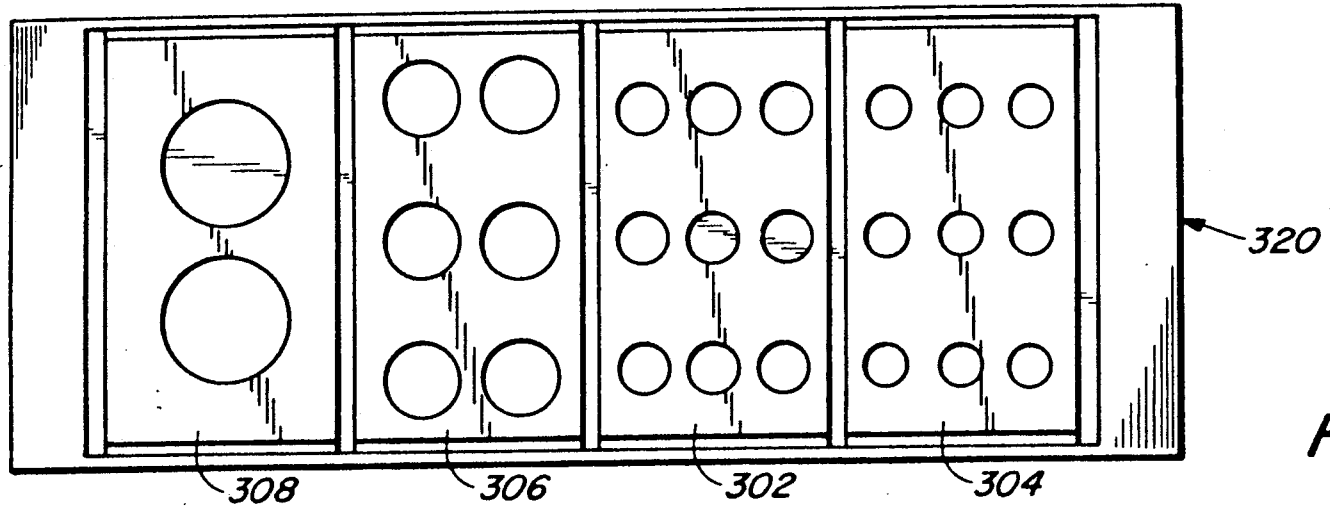
FIG._9A.
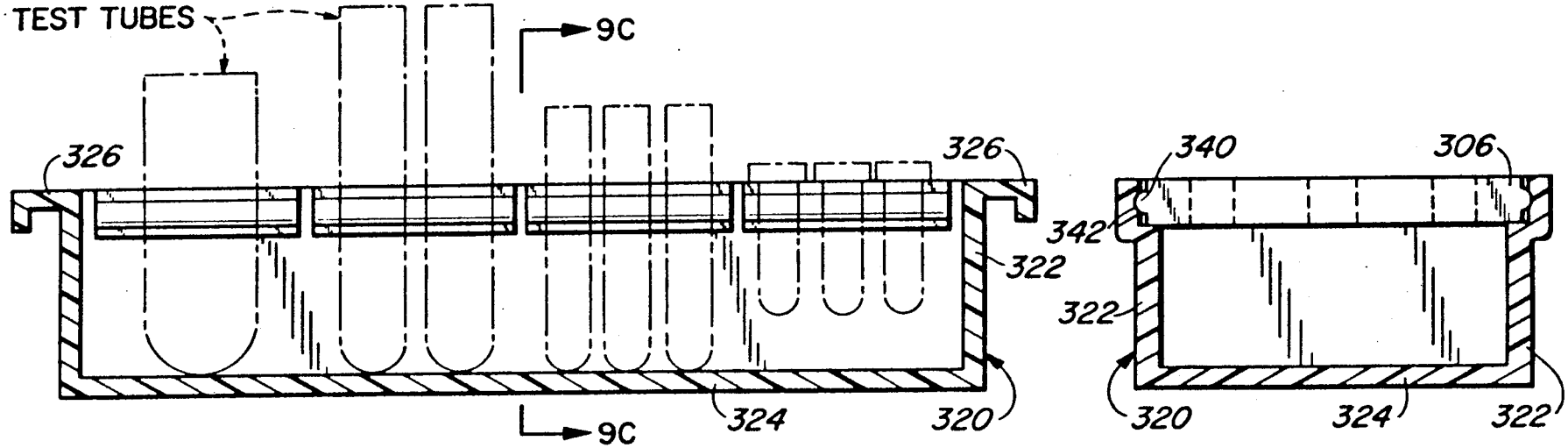
FIG._9B.
FIG._9C.

TEST TUBE SUPPORT SYSTEM

This is a continuation-in-part of Ser. No. 07/370,643, filed Jun. 22, 1989 now U.S. Pat. No. 4,938,369, Jul. 3, 1990, entitled MULTIPLE-OPTION TEST TUBE SUPPORT SYSTEM.

The present invention relates generally to a system for holding and supporting test tubes, and particularly to a system which simultaneously support test tubes of varying sizes.

BACKGROUND OF THE INVENTION

The present invention is an improvement on the test tube racks provided in the prior art, as exemplified by the systems disclosed in U.S. Pat. Nos. 3,379,315 (Broadwin), 3,233,804 (Dahm), 3,778,232 (McMorrow, Jr.), 2,189,989 (Lichtman), 3,674,198 (Eberle) and 4,068,798 (Rohde).

In particular, there are test tube racks available for all of the different sizes of manufactured test tubes. However, in order to meet the needs for any one experiment, perhaps as many as four different types of test tube racks must be easily within reach to store different sizes of test tubes containing various chemical solutions. This is an inefficient use of laboratory benchtop space characteristic of the prior art.

Another shortcoming of the currently available test tube racks concerns the requirement for long-term storage of multiple types and sizes of support racks. The different racks generally cannot be stacked together, and hence do not make efficient use of storage space.

SUMMARY OF THE INVENTION

In summary, the present invention is a test tube support system which simultaneously holds a plurality of test tubes of different sizes. In one embodiment, the test tube support system includes a plurality of rectangular box-shaped units, each having four faces. The faces are plastic, injection molded plates, each having a depth of between 0.25 and 0.50 inches with a plurality of tapered holes therethrough. More generally, the plates have sufficient depth so that the holes in these plates provide side wall support to test-tubes of corresponding size stored vertically therein, and thereby prevent tipping of test tubes stored vertically in the support system. Also, the holes in each plate are of differing diameter than the other plates of the unit. A support or carrier tray holds a plurality of these units. Each unit may be differently oriented so that test tubes of various sizes may be stored in the test tube support system.

In another embodiment, the test tube support system has a multiplicity of rectangular, plastic, injection molded plates, similar to the plates in the rectangular box-shaped units. A carrier tray is designed to receive and retain several plates and to provide empty space below the holes in the plates. The tray is designed to allow individual ones of the plates to be removed and replaced with other ones of the plates so that test tubes of various sizes may be stored in the test tube support system.

BRIEF DESCRIPTION OF THE DRAWINGS

Additional objects and features of the invention will be more readily apparent from the following detailed description and appended claims when taken in conjunction with the drawings, in which:

FIGS. 9A–9C depict a top plan view, a front elevation view and a side elevation view, respectively, of a carrying tray with four holding plates inserted therein.

DESCRIPTION OF THE PREFERRED EMBODIMENTS

Figure 5:
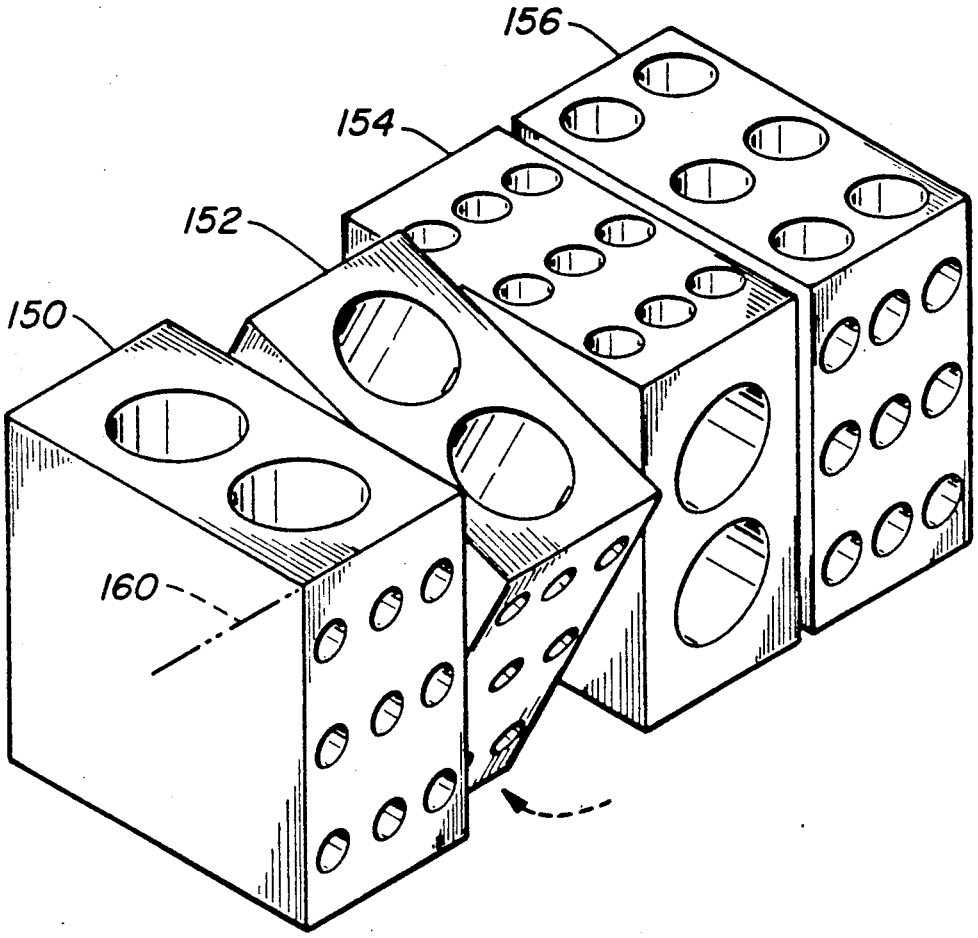
FIG. 5 is a perspective view of four rotatably interconnected modules, in accordance with a second embodiment of the present invention.
Figure 6:
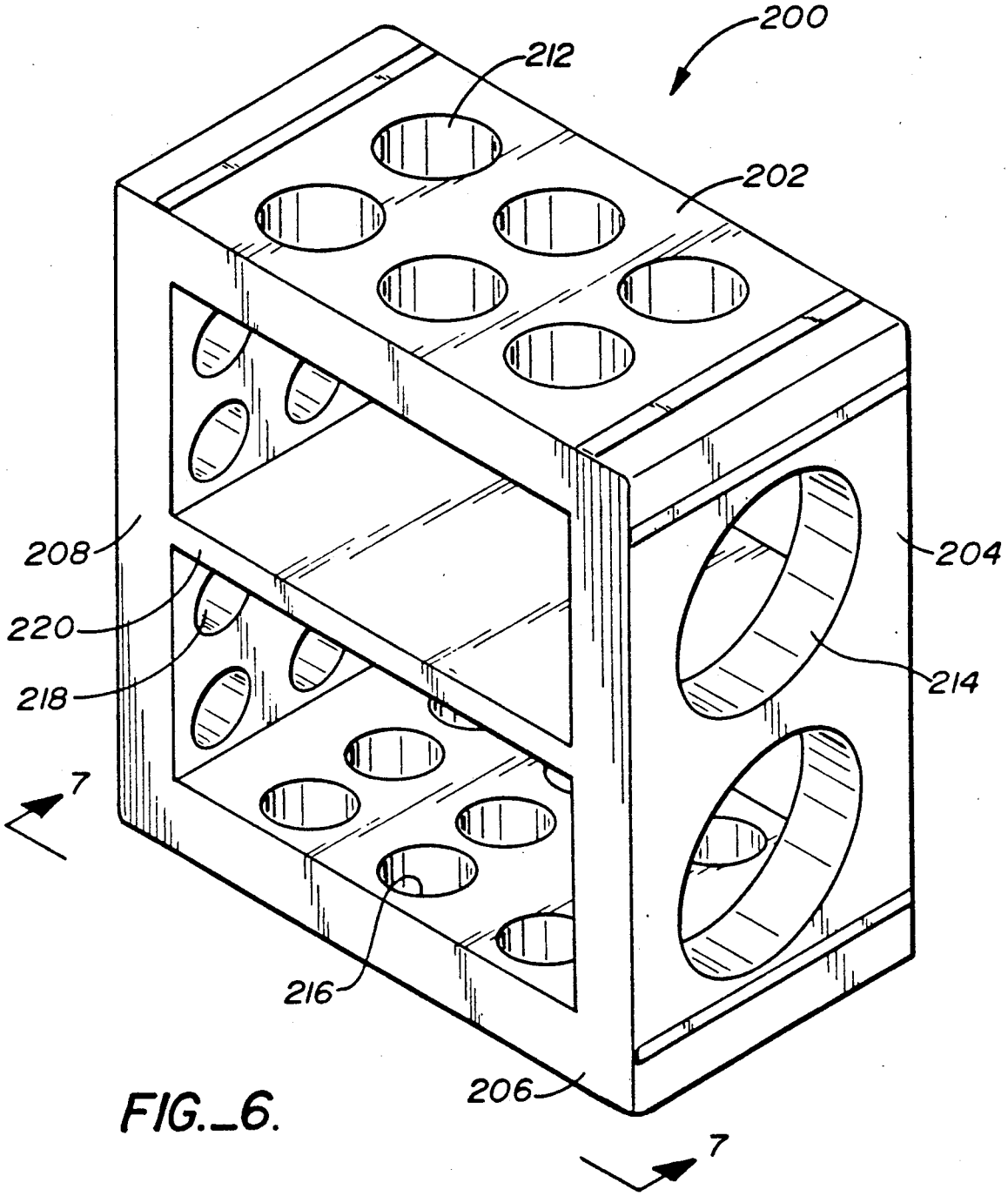
FIG. 6 is a perspective view of a single module of a third embodiment of a test tube support system in accordance with the present invention.
Figure 7:
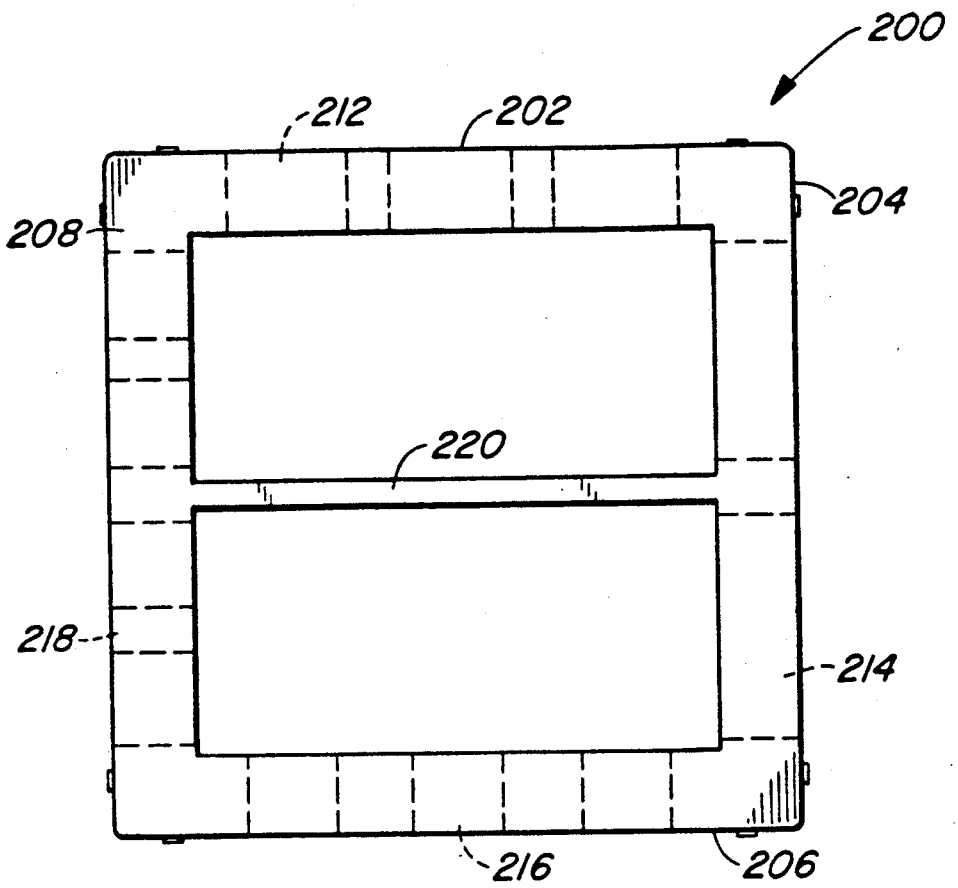
FIG. 7 is a sectional of the module shown in FIG. 6.
Figure 8:
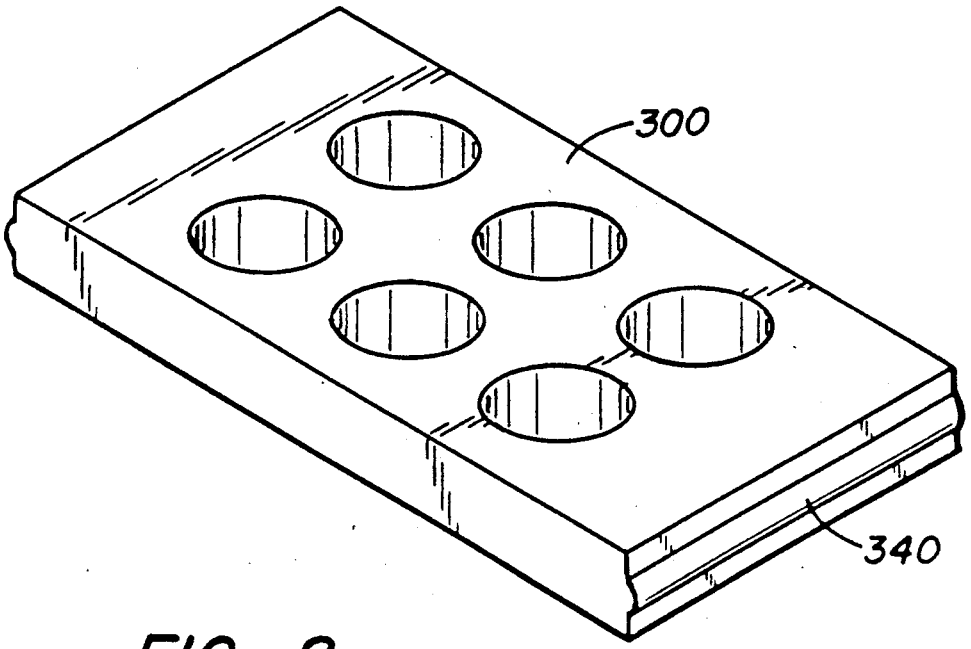
FIG. 8 is a perspective view of a single test tube holding plate, used in a fourth embodiment of the present invention.

Four preferred embodiments of the invention are presented. FIGS. 1–4 relate to a first embodiment in which four test support modules are contained within a carrying tray. FIG. 5 depicts a second embodiment in which several modules are rotatably interconnected allowing use without a carrying tray. FIGS. 6 and 7 depict a third embodiment which is similar to the first preferred embodiment, except that it uses plastic, injection molded modules. FIGS. 8 and 9 depict a fourth embodiment in which test tube holding plates are removably inserted in a carrier tray.

Figure 1:
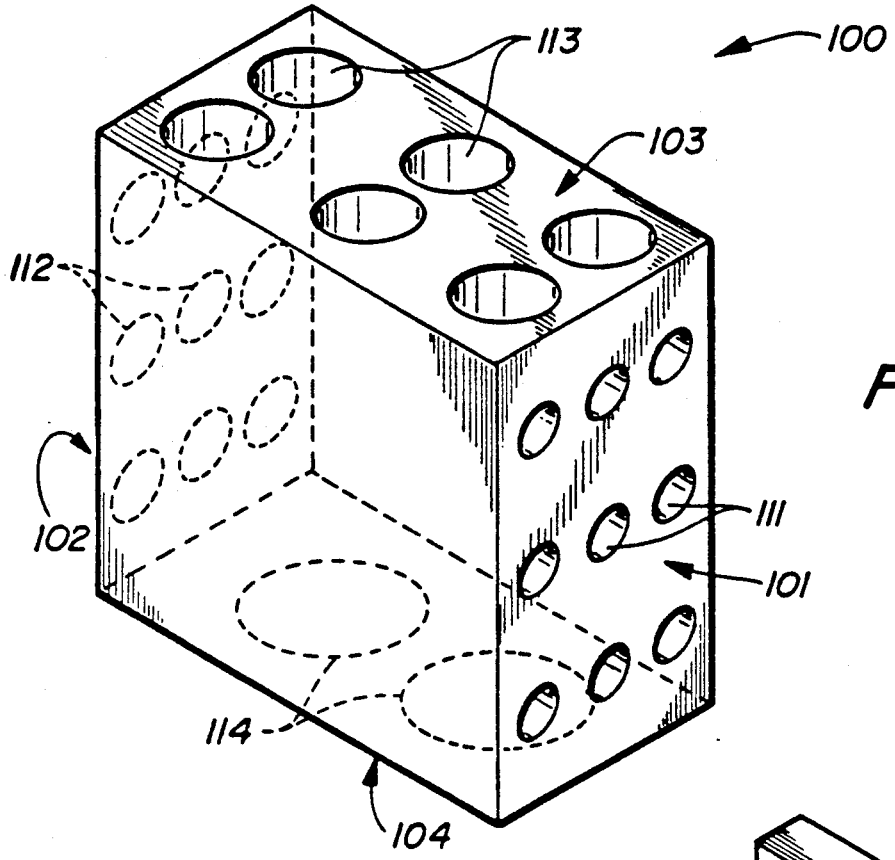
FIG. 1 is a perspective view of a single module of an multiple module test tube support system.

Referring to FIG. 1, an individual test tube holding module 100 has four faces 101, 102, 103 and 104 and penetrating holes 111, 112, 113 and 114. The module 100 in this first preferred embodiment comprises a block of homogeneous material, such as plastic, with holes 111–114 penetrating four faces of the module. The material used in constructing the module may vary with the specific temperature and chemical resistance requirements of a particular application. The dimensions of one implementation of the module 100 are 9 cm×9 cm×5 cm. The diameters of holes 111–114 are 1.2 cm for face 101, 1.4 cm for face 102, 1.9 cm for face 103, and 3.3 cm for face 104.

In all of the embodiments shown herein, the preferred type of plastic is ultraviolet stabilized polypropylene, which can withstand temperatures ranging from −80 to 120 degrees Celsius.

Figure 2:
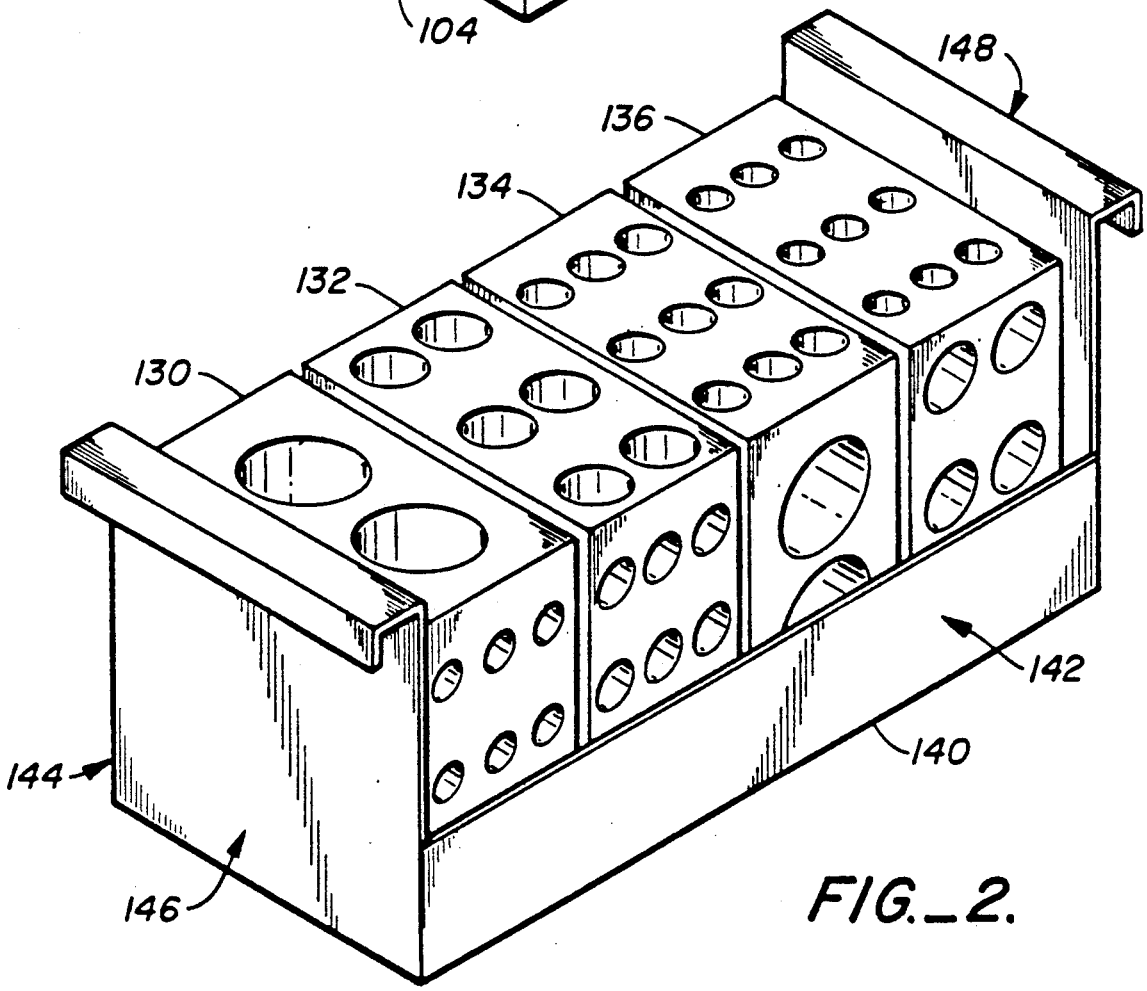
FIG. 2 is a perspective view of a first preferred embodiment of an multiple module test tube support system.

Referring to FIG. 2, there is shown a perspective view of four modules 130, 132, 134 and 136 placed in a carrying tray 140. Each module 130–136 has a distinct orientation for supporting test tubes of a corresponding size. It is possible to utilize any combination of module orientations to support different combinations of test tube sizes.

Figure 3:
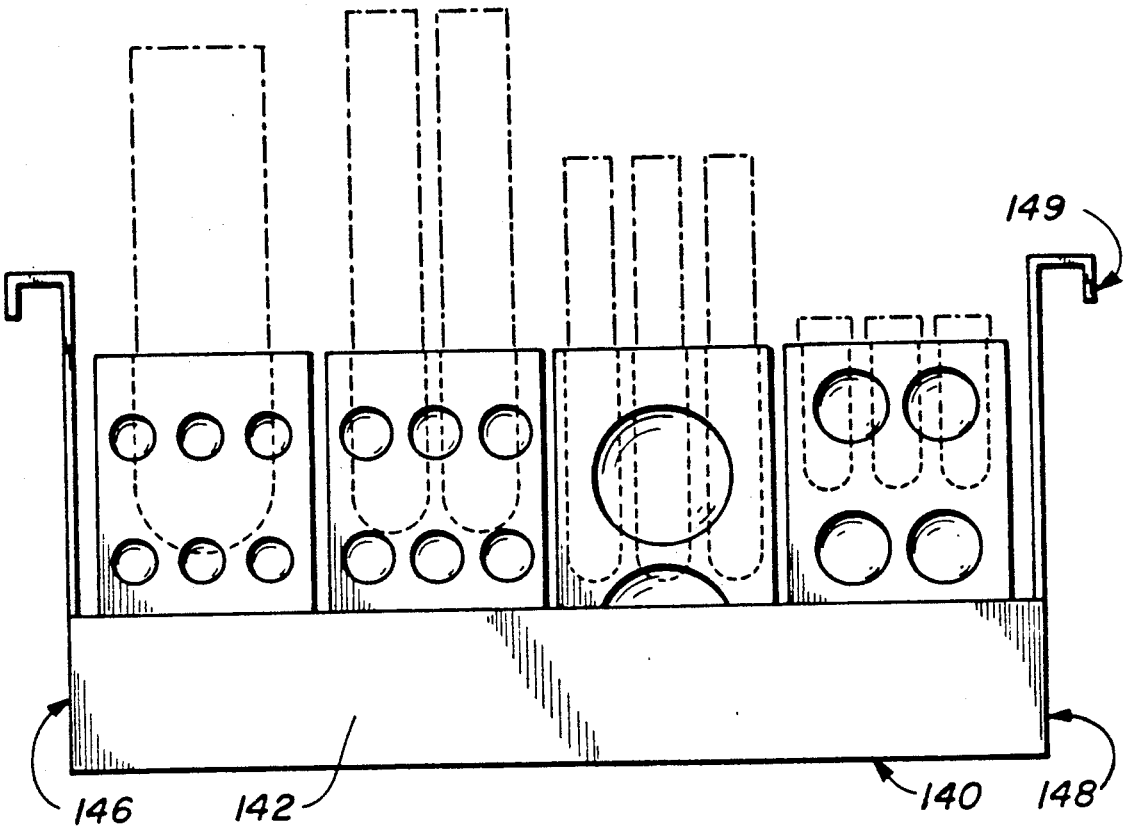
FIG. 3 is a front elevation view of the multiple module test tube support system shown in FIG. 2.

Referring to FIGS. 2 and 3, the dimensions of the carrying tray are approximately 20.5 cm×9.3 cm, with a height of 4 cm along the front 142 and back 144 of the tray and a height of 11 cm along its sides 146 and 148. The sides 146 and 148 include a lip or handle 149 for ease of carrying. The two handles 149 each extend about 1.4 cm to 1.6 cm out from the sides 146 and 148. An advantage of this embodiment is that the carrying tray and modules are of uniform size and therefore easily stackable for storage.

Figure 4:
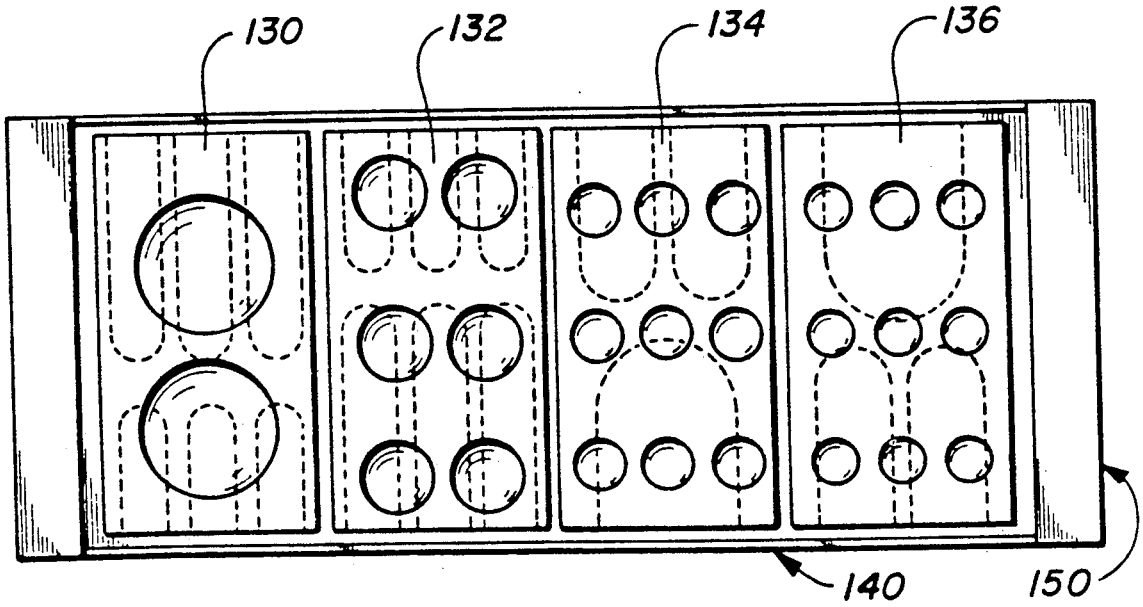
FIG. 4 is a plan view of the multiple module test tube support system shown in FIG. 2.

Referring to the plan view in FIG. 4, it can be seen that the individual modules are not connected. This allows any of the four modules 130–136 to be removed, and if desired, rotated, to either allow exposure of a different size of support hole, or transport of an individual module to another location independent of the other modules. This is a vast improvement over the prior art method of using separate large test tube support racks for moving a small number of test tubes from one location to another, or for times when the number of test tubes of each size changes somewhat.

FIG. 5 shows an alternate embodiment of the present invention, intended to be used when it is anticipated that all four modules will be used routinely, without need to remove one module from the others. In this embodiment all four modules 150, 152, 154 and 156 are coupled to a central axis 160 (i.e., an axle located along a central axis) around which the modules can be rotated to their desired positions. This embodiment allows the modules to be attached to one another without recourse to an additional piece of equipment (e.g., a carrying tray), although the use of a carrying tray may be desirable in some applications.

FIG. 6 shows a plastic, injection molded module 200 that is used in a third preferred embodiment of the invention. FIG. 7 shows a cross-sectional view of the module 200. The module 200 has four faces 202, 204, 206 and 208, each with different sized holes 212, 214, 216 and 218. The dimensions of the module 200 and its holes are substantially the same as the dimensions of the module 100 and its holes, shown in FIG. 1.

Each face is a plastic, injection molded plate about 1 cm thick. More generally, each face must be at least approximately 0.6 cm or 0.25 inches thick so that holes through the faces have sufficient depth to provide side wall support to test-tubes of corresponding size stored vertically therein, which prevents tipping of test tubes stored vertically in the support system. Faces with thicknesses ranging from 0.6 to 1.2 cm or 0.25 to 0.5 inches are preferred.

The plates which form the four faces of the module 200 are separately injection molded and then assembled into a single rectangular box-shaped unit with an additional plastic support member 220 to improve the strength of the module 200. The plates are formed using standard plastic injection molding techniques.

Figure 11:
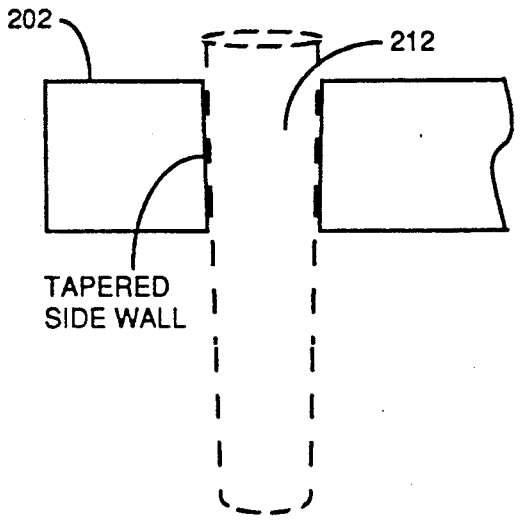
FIG. 11 depicts a cross section of a portion of one face of a test-tube module, showing a tapered hole therethrough.

It should be noted that the side walls of test tubes are slightly tapered. The holes 212, 214, 216 and 218 in the module's faces are also tapered at an angle which approximately matches the tapered sides of correspondingly sized test tubes, as shown in FIG. 11.

When four of the modules 200 are placed in a tray, the resulting test tube support system is as shown in FIG. 2.

Referring to FIG. 8, a fourth preferred embodiment uses individual, rectangular plates 300, each of which are substantially the same as the injection molded plates used to form faces 202, 204, 206 and 208 of module 200. In the preferred embodiment there are four versions of plate 300, each having holes of a distinct size.

Referring to FIG. 9A, test tube holding plate 302 has holes of diameter 1.2 cm, plate 304 has holes of diameter 1.4 cm, plate 306 has holes of diameter 1.9 cm, and plate 308 has holes of diameter 3.3 cm. Each plate 302–308 is approximately 1.2 cm thick. More generally, each plate must be at least approximately 0.6 cm or 0.25 inches so that holes through the plates have sufficient depth to provide side wall support to correspondingly sized test tubes and thus to prevent tipping of test-tubes stored vertically therein. Plates with thicknesses ranging from 0.6 to 1.2 cm or 0.25 to 0.5 inches are preferred.

As shown in FIGS. 9A, 9B and 9C, a carrier tray 320 is designed to receive and retain four plates 302–308 and to provide empty space below the holes in the plates. In particular, the plates 302–308 are held approximately 4.1 centimeters above the floor of the tray 320. The tray 320 is also designed to allow individual ones of the plates to be removed and replaced with other ones of the plates so that test tubes of various sizes may be stored in the test tube support system. As shown, the tray 320 has the shape of an open box with side walls 322 about 5.1 cm high, a base 324 that is about 20.875 cm long and 8.8 cm wide, with the walls 322 and base 324 all about 0.4 cm thick. The two handles 326 each extend about 1.6 cm out from the side walls. As shown in FIG. 8 and 9C, two sides of each test tube holding plate 300 have a rib 340, with a radius of about 0.256 cm, which mates with a grove 342 in the front and rear sides of the tray. The rib 340 and groove 342 together function to allow test tube holding plates 302–308 to be snapped in and out of the tray 320, which allows the user to select the plates to be installed in the tray in accordance with the test tubes that are being used.

Figure 10:
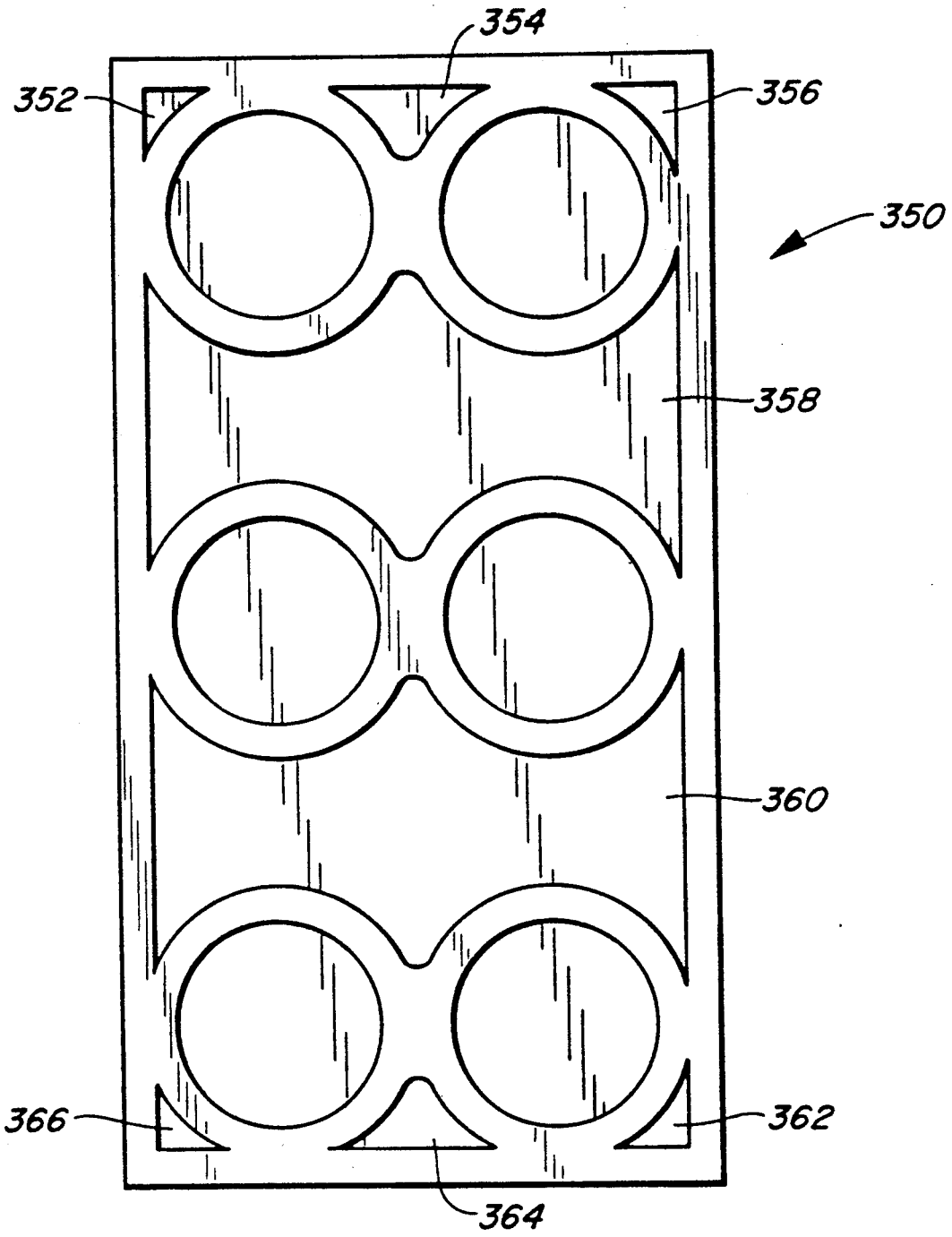
FIG. 10 depicts a test tube holding plate manufactured using cored plastic injection molding.

FIG. 10 shows an alternate embodiment of plate 306. This plate 350 is formed using "cored" plastic, manufactured using standard injection molding techniques. Cored sections 352–366 represent plastic that has been removed from the plates shown in FIGS. 8 and 9A–9C by using a different mold. As a result, the bulk of the test tube support apparatus is reduced, allowing the use of faster curing times and reducing the costs of manufacturing. The tray 320 provides the necessary bulk for a stable test tube support apparatus.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A test tube support, comprising:

a rectangular box-shaped unit having four faces, at least three of said faces comprising injection molded plastic plates, said plates each having a depth of at least 0.25 inches and a plurality of holes of various diameters therethrough, said holes through said plates having sufficient depth to prevent tipping of test-tubes stored vertically therein;

wherein said holes are tapered at an angle which approximately matches tapered sides of correspondingly sized test tubes.

2. The test tube support of claim 1, wherein each of said at least three faces has holes of a different diameter.

3. A test tube support system, comprising a plurality of rectangular box-shaped test tube support units, each unit having four faces, at least three of said faces comprising injection molded plastic plates, said plates each having a depth of at least 0.25 inches and a plurality of holes of various diameters therethrough, said holes through said plates having sufficient depth to prevent tipping of test-tubes stored vertically therein; and support means for holding said plurality of units, wherein each of said units may be differently oriented so that test tubes of various sizes may be stored in said test tube support system.

4. The test tube support system of claim 3, wherein each of said faces has holes of a different diameter.

5. The test tube support system of claim 3, wherein said holes are tapered at an angle which approximately matches tapered sides of correspondingly sized test tubes.

6. A test tube support, comprising: a rectangular box-shaped unit having four equal size faces, a multiplicity of said faces having a plurality of holes of various diameters, each said face comprising a plate having sufficient depth so that said holes in said faces provide side wall support to test-tubes of corresponding size stored vertically therein, thereby prevent tipping of test tubes stored in said support; wherein each of said multiplicity of faces has holes of a different diameter;

whereby a plurality of identical ones said units may be used, each said unit having a selected orientation, so that test tubes of various sizes may be stored in said units.

7. The test tube support system of claim 6, wherein said holes are tapered at an angle which approximately matches tapered sides of correspondingly sized test tubes.

8. A test tube support system, comprising a multiplicity of rectangular injection molded plastic plates, said plates each having a depth of at least 0.25 inches and a plurality of holes of various diameters therethrough, said holes through said plates having sufficient depth to prevent tipping of test-tubes stored vertically therein; and support means for receiving and retaining at least a plurality of said plates, said support means providing an empty space below said holes in said plates in said support means; said support means allowing individual ones of said plates to be removed and replaced with other ones of said plates so that test tubes of various sizes may be stored in said test tube support system.

9. The test tube support system of claim 6, wherein said holes are tapered at an angle which approximately matches tapered sides of correspondingly sized test tubes.

* * * * *